United States Patent [19]

Pinson

[11] Patent Number: 4,521,782

[45] Date of Patent: Jun. 4, 1985

[54] TARGET SEEKER USED IN A POINTER AND TRACKING ASSEMBLY

[75] Inventor: George T. Pinson, Huntsville, Ala.

[73] Assignee: The Boeing Company, Seattle, Wash.

[21] Appl. No.: 491,898

[22] Filed: May 5, 1983

[51] Int. Cl.[3] ..... H01Q 3/08

[52] U.S. Cl. ..... 343/765; 343/781 P

[58] Field of Search ..... 74/86, 491; 343/765, 343/766, 882, 781 P

[56] References Cited

U.S. PATENT DOCUMENTS

| | | | |
|---|---|---|---|
| 2,654,031 | 9/1953 | Mullins et al. | 343/765 |
| 2,762,234 | 9/1956 | Dodd | 343/765 |
| 3,589,208 | 6/1971 | Brero | 74/491 |

*Primary Examiner*—Eli Lieberman

*Attorney, Agent, or Firm*—Edwin H. Crabtree

[57] ABSTRACT

An improved target seeker used in a pointer and tracking assembly for searching a large area in an X-Y plane, commonly called a field of regard. The improved seeker can search the field of regard using sweeps, spirals, circles and other types of scan patterns without blind spot restrictions.

8 Claims, 3 Drawing Figures

TARGET SEEKER USED IN A POINTER AND TRACKING ASSEMBLY

BACKGROUND OF THE INVENTION

This invention relates to a target seeker and more particularly but not by way of limitation to an improved target seeker used in a pointer and tracking assembly for searching a large field of regard.

Heretofore, there have been large numbers of different types of pointer and tracking assemblies designed for use in missile seeking applications. They include a spectrum of devices used in astronomy and radar and seeking applications. The devices include a equitorial mount, azimuth/elevation mount and X-Y radar mount, spinning mass stabilized mount, inertially stabilized mount and two and three axis gimbals. Also, a nongimbal pointer and tracking platform assembly is described in U.S. Pat. No. 4,158,845 issued to the inventor of the subject application. The patents cited during the prosecution of this patent are incorporated herein by reference.

The tracking platform assembly described in U.S. Pat. No. 4,158,845 is unique in design and differs substantially from the prior art pointer and tracking assemblies but suffers in its preferred implimentation from having a dead spot in the center of the field of view. The design flaw is caused by the use of a spiral in a slit in the drive elements. Since a spiral originates from some center and center crossover cannot be permitted since the system would lock-up, a blind spot occurs at the spiral origin. Since the origin of the spiral need not occur at the center, the blind spot can be moved off axis. However, a blind spot will still occur at some point in the field of regard. The subject improved target seeker solves the above mentioned problem along with additional advantages as described herein.

SUMMARY OF THE INVENTION

The improved target seeker used in a pointer and tracking assembly can search a large field of regard and is without blind spot restrictions.

The target seeker is low in cost, high speed and can search an area intercepted by a half angle cone with angles up to and exceeding 45 degrees.

Further the improved target seeker used in conjunction with the pointer and tracking assembly can search in sweeps, spirals, circles and any other scan pattern desired.

The improved target seeker used in a pointer and tracking assembly includes a primary mirror attached to a movable head. The head includes a stylus extending outwardly from the rear of the head. A secondary mirror is attached to a spider mounted in front of the head for focusing electromagnetic energy received thereon and onto a detector attached to the movable head and centered thereon. An X drive plate oriented in an X axis and having a drive slot therein is rotatably attached to part of the assembly. A Y drive plate oriented in a Y axis and having a drive slot therein is rotatably attached to part of the assembly. The stylus is received through the drive slots of the X and Y drive plates. Means for rotating the X drive plate and Y drive plate move the two drive plates and the movable head for detecting and following a desired target.

The advantages and objects of the invention will become evident from the following detailed description of the drawings when read in connection with the accompanying drawings which illustrate preferred embodiments of the invention.

DETAILED DESCRIPTION OF THE DRAWINGS

Figure 1:
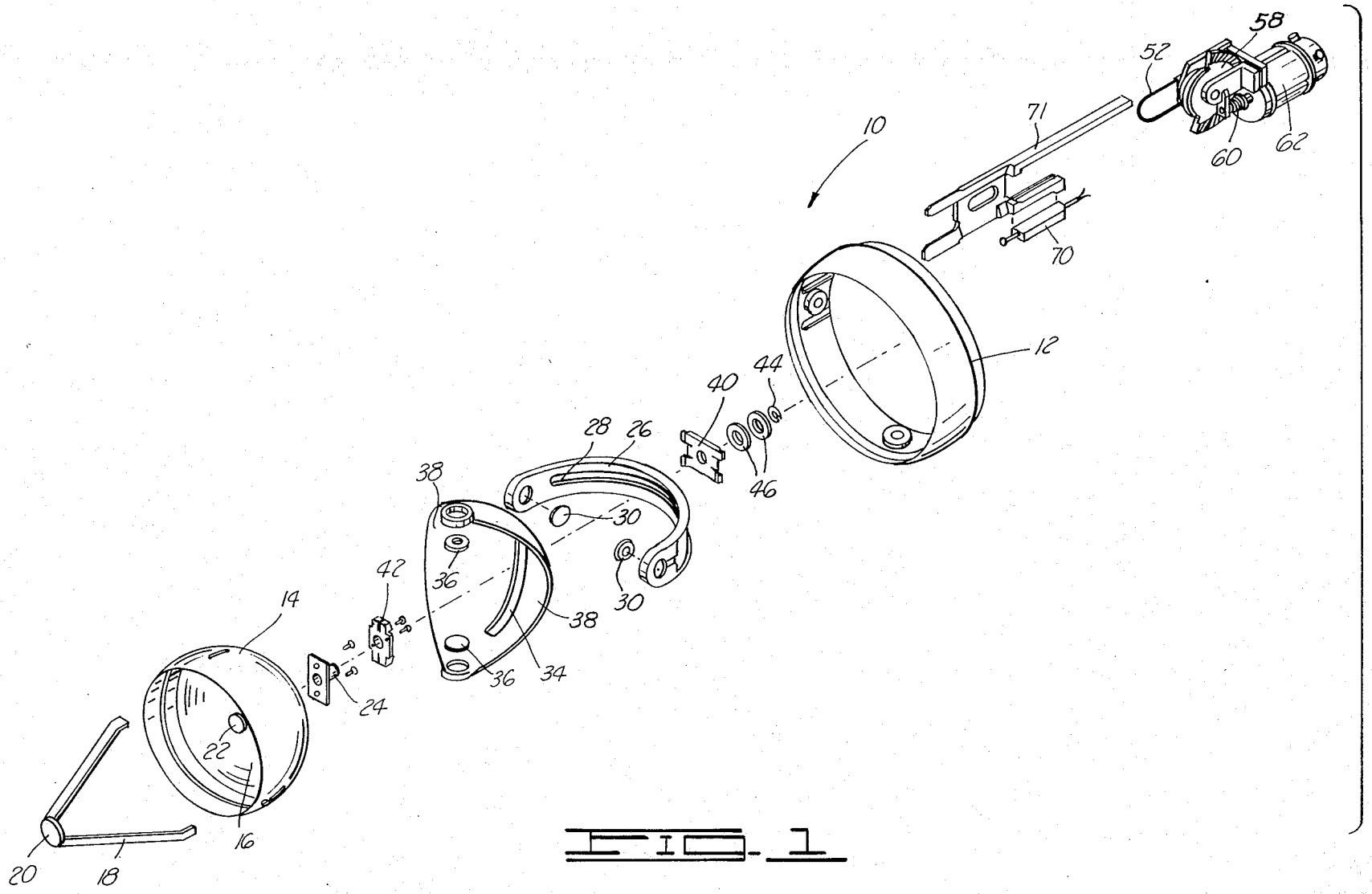
FIG. 1 is an exploded perspective view of the target seeker.

In FIG. 1 the improved target seeker is designated by general reference numeral 10. The seeker 10 is part of a pointer and tracker assembly. The entire assembly is not shown in the drawings but part of the assembly is a fixed support ring 12. Part of the target seeker 10 is a spherical movable head 14. While the head 14 is shown as being spherical, it could also be cylindrical and other geometric shapes without departing from the spirit of the invention.

Mounted on the front of the head 14 is a primary mirror 16 which acts as a sensing element. While the mirror 16 is shown it could also be a radar antenna or any other type of sensing device. Extending outwardly from the front of the head 14 is a spider 18 for receiving a secondary mirror 20 thereon. Again, the secondary mirror 20 is a sensing element for receiving electromagnetic energy from the primary mirror 16 and focusing this energy onto a detector 22 centered on the mirror 16 and head 14. Extending outwardly from the rear of the head 14 is a stylus 24. The stylus 24 may be hollow for receiving electrical wiring 27 therethrough from the detector 22. The wiring 27 is shown in FIG. 2.

The seeker 10 further includes an X axis drive plate 26 having an elongated slot 28 therein. The plate 26 also includes bearings 30 for rotatably mounting the ends of the plate 26 to the support ring 12. Also there is a Y axis drive plate 32 having an elongated slot 34 therein with the ends of the plate 32 having bearings 36 for rotatably mounting the plate 32 to the ring 12. The plate 32 further includes bearing surfaces 38 which act as ball joints to retain the removable head 14 in a fixed low friction separation from the sides of the plate 38.

The stylus 24 is held in the slots 28 and 34 by nylon sliders 40 and 42 and a retainer clip 44 with washers 46. The sliders 40 and 42 while holding the stylus 24 in place allow the stylus 24 to move along the length of the slots 28 and 34 as the movable head 14 rotates thereon.

Figure 2:
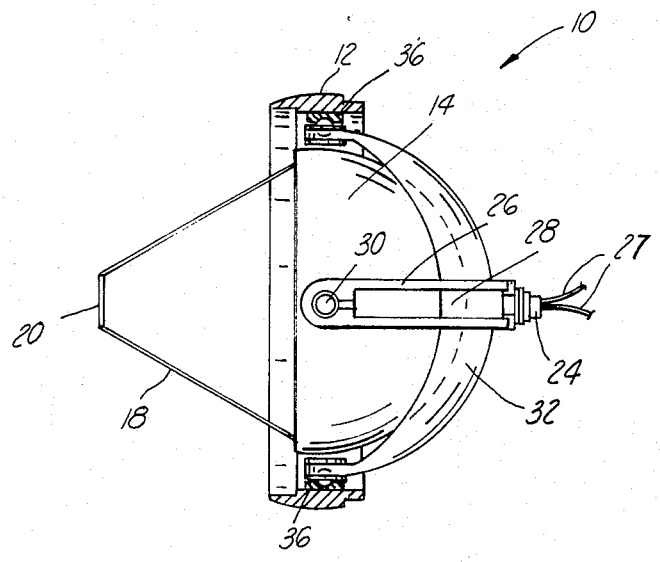
FIG. 2 is a side view of the improved target seeker with a portion of the support ring cut away.

In FIG. 2 a portion of the support ring 12 has been cut-away to show a side view of the improved target seeker 10 with the drive plates 26 and 32 receiving the stylus 24 of the movable head 14 through the elongated slots 28 and 34. Also in this view the ends of the X and Y drive plates 26 and 32 are secured to the bearings 30 and 36 which secure the plates to the inner diameter of the support ring 12 and rotatable movement thereon.

Figure 3:
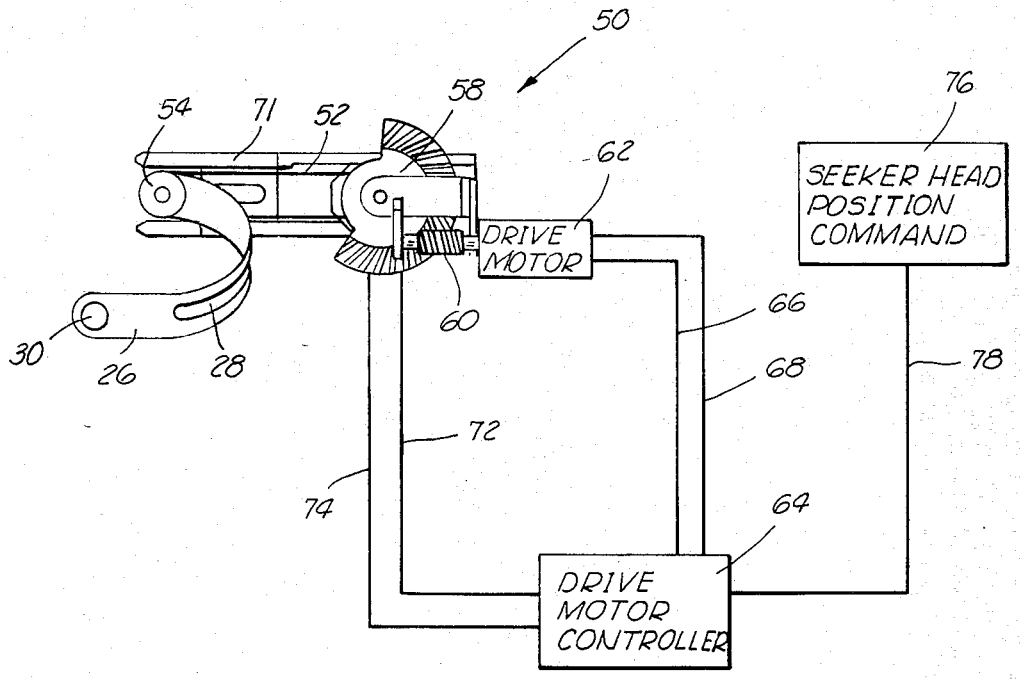
FIG. 3 illustrates a typical drive system for rotating the X axis drive plate.

In FIG. 3 a typical position drive designated by general reference numeral 50 is shown. The position drive 50 includes a drive wire 52 mounted on a pulley 54 attached to the X axis drive plate 26. The endless drive wire 52 is also mounted around a drive gear 58 which is driven by a worm gear 60 attached to a drive motor 62. The drive motor 62 is controlled by a drive motor controller 64 via motor control lead 66 and 68. The controller 64 is governed by a position potentiometer 70 shown in FIG. 1 and mounted on a motor bracket 71 and connected to the controller 64 via leads 72 and 74. The drive motor 62 is controlled by a seeker head position command 76 connected to the controller 64 via lead 78. The position of the axis drive plate 26 is obtained from the position potentiometer 70. The potentiometer 70 output is provided to the drive motor controller 64. The drive motor 62 is then powered by the drive motor controller 64 which provides the feedback control loop between the command position generated by the seeker head position command 76 and the actual position as determined by the potentiometer 70.

While the position drive 50 is shown for driving the X axis drive plate 26, the driving of the Y axis drive plate 32 is identical. Also, it should be kept in mind, while the position drive 50 is described as shown in FIG. 3 and X and Y drive plates could also be driven equally well with a typical linkage drive, gear combination drive, cam linkage drive and other typical electro-mechanical drives used in pointer and tracking assemblies.

From reviewing the above mentioned drawings, it can be appreciated by driving the X axis and Y axis drive plates, the stylus 24 received in the drive slots in turn moves the movable head 14 in an X-Y plane in a manner where there is no restrictions such as blind spots and a search can be conducted using various types of scan patterns to accurately track a target in a field of regard rapidly and without restriction.

Changes may be made in the construction and arrangements of the parts of elements of the embodiments as described herein without departing from the spirit or scope of the invention defined in the following claims.

What is claimed is:

1. An improved target seeker used in a pointer and tracking assembly, the seeker comprising:

a primary sensing element attached to a movable head, the movable head having a stylus mounted thereon;

a secondary sensing element attached to the front of the head for focusing the electromagnetic energy received onto a detector, the detector attached to the movable head and centered thereon;

an X drive plate oriented in an X axis, the ends of the plate attached to part of a fixed frame of the assembly;

a Y drive plate oriented in a Y axis, the ends of the plate attached to part of a fixed frame of the assembly, the stylus engaged by the X and Y drive plates for moving the head;

means for rotating the X drive plate around an X axis; and means for rotating the Y drive plate around a Y axis.

2. The seeker as described in claim 1 wherein the primary sensing element and secondary sensing element are mirrors.

3. The seeker as described in claim 1 wherein the movable head is spherical in shape.

4. The seeker as described in claim 1 wherein the secondary sensing element is supported on a spider, the spider attached to the front of the movable head.

5. The seeker as described in claim 1 wherein the stylus is centered on the rear of the movable head.

6. The seeker as described in claim 1 wherein the X and Y drive plates are rotatably mounted on a support ring, the support ring is part of the fixed frame of the assembly.

7. The seeker as described in claim 1 wherein the primary sensing element is a radar antenna.

8. An improved target seeker used in a pointer and tracking assembly, the seeker comprising:

a primary sensing element attached to a movable head, the movable head having a stylus centered thereon and mounted on the rear thereof;

a secondary sensing element attached to a spider, the spider mounted on front of the movable head, the secondary sensing element focusing the electromagnetic energy received onto a detector, the detector attached to the front of the movable head and centered thereon;

an X drive plate oriented in an X axis and having a drive slot therein, the ends of the plate attached to part of a fixed frame of the assembly;

a Y drive plate oriented in a Y axis and having a drive slot therein, the ends of the plate attached to part of a fixed frame of the assembly;

the stylus received through the drive slots of the X and Y drive plates;

means for rotating the X drive plate around an X axis and means for rotating the Y drive plate around a Y axis.

* * * * *